US006702903B2

(12) United States Patent
Kawakami et al.

(10) Patent No.: US 6,702,903 B2
(45) Date of Patent: Mar. 9, 2004

(54) WASHING METHOD OF PETROLEUM EQUIPMENT AND WASHING SOLUTION FOR USE WITH THE METHOD

(75) Inventors: Katshuiko Kawakami, Tokyo (JP); Hirozumi Hosokawa, Chiba (JP)

(73) Assignee: Softard Industries Co., Ltd., Tokyo (JP)

( * ) Notice: Subject to any disclaimer, the term of this patent is extended or adjusted under 35 U.S.C. 154(b) by 0 days.

(21) Appl. No.: 10/268,681

(22) Filed: Oct. 11, 2002

(65) Prior Publication Data

US 2003/0037807 A1 Feb. 27, 2003

Related U.S. Application Data

(63) Continuation-in-part of application No. 09/534,172, filed on Mar. 24, 2000, now abandoned.

(51) Int. Cl.[7] ..... B08B 3/00

(52) U.S. Cl. ..... 134/26; 134/22.1; 134/22.11; 134/22.14; 134/22.19; 134/29; 134/36; 134/40; 134/42

(58) Field of Search ..... 134/22.1, 22.11, 134/22.14, 22.19, 26, 29, 36, 40, 42

(56) References Cited

U.S. PATENT DOCUMENTS

| | | | | | |
|---|---|---|---|---|---|
| 2,805,200 | A | * | 9/1957 | Lee et al. | 507/203 |
| 5,389,156 | A | | 2/1995 | Mehta et al. | 134/10 |
| 5,634,984 | A | * | 6/1997 | Van Slyke | 134/40 |
| 5,662,269 | A | | 9/1997 | Francis | 134/107 |
| 5,814,594 | A | | 9/1998 | Vlasblom | 510/365 |
| 5,863,881 | A | | 1/1999 | Vlasblom | 510/365 |
| 5,904,208 | A | | 5/1999 | Ray et al. | 166/312 |
| 6,143,709 | A | | 11/2000 | Carey | 510/269 |
| 6,235,698 | B1 | | 5/2001 | Vlasbom | 510/365 |
| 6,239,097 | B1 | | 5/2001 | Wilson | 510/405 |
| 6,260,620 | B1 | | 7/2001 | Furman et al. | 166/267 |
| 6,273,102 | B1 | | 8/2001 | Kawakami et al. | 134/22.1 |
| 2003/0037807 | A1 | * | 2/2003 | Kawakami et al. | 134/26 |

FOREIGN PATENT DOCUMENTS

| | | | |
|---|---|---|---|
| JP | 10-316997 | * | 2/1998 |
| JP | 2000-345376 | * | 12/2000 |
| WO | WO200075400 A1 | * | 12/2000 |

* cited by examiner

*Primary Examiner*—Sharidan Carrillo
(74) *Attorney, Agent, or Firm*—Lowe Hauptman Gilman & Berner LLP

(57) ABSTRACT

A washing method of petroleum equipment using washing solution capable of being used in a waterless environment is provided. A compound of surface-active agent and oil is used as the washing solution of the petroleum equipment. Content of the surface-active agent in the compound is preferably 1 to 20 volume %. The surface-active agent is preferably selected from the group consisting of anionic surface-active agent, cationic surface-active agent, amphoteric surface-active agent and nonionic surface-active agent. The oil is preferably at least one selected from the group consisting of kerosene, light gas oil, vacuum gas oil and light cycle oil fraction obtained from a fluid catalystic cracking unit.

16 Claims, 2 Drawing Sheets

WASHING METHOD OF PETROLEUM EQUIPMENT AND WASHING SOLUTION FOR USE WITH THE METHOD

This application is a Continuation-In-Part application of Ser. No. 09/534,172, filed Mar. 24, 2000, now abandoned.

BACKGROUND OF THE INVENTION

1. Field of the Invention

The present invention relates to a method of washing petroleum equipment and a washing solution for use with the method.

2. Description of Related Art

Conventionally, it has been considered that water as well as surface-active agent are requisites for washing fluids used for washing petroleum equipment. When petroleum flows into sea, for example, surface-active agents are used to remove the petroleum because the surface-active agents can minutely disperse the petroleum in combination with sea-water as a solvent.

As mentioned above, since water for the surface-active agent to be dispersed therein is a requisite for removing petroleum residue by the surface-active agent, it has been thought that the petroleum residue could not be removed by the surface-active agent in a waterless place.

However, in petroleum refining equipment, a part of petroleum is degraded to turn into macromolecule petroleum, which adheres on a wall of the equipment to be further firmly adhered (highly polymerized). The highly polymerized compound (referred to as petroleum residue hereinafter) becomes gradually thicker and thicker, which exerts bad influence on performance of the petroleum equipment. For instance, such petroleum residue significantly deteriorates heat exchange efficiency of the equipment.

Therefore, it is necessary to wash petroleum equipment for removing petroleum residue therefrom. However, when a water-containing washing solution is used, the petroleum equipment may be damaged or bad influence is caused on products on account of residual water. Accordingly, petroleum-rinsing or drying process has to be conducted after washing the petroleum equipment with the water-containing washing solution. As a result, the total equipment downtime is lengthened.

SUMMARY OF THE INVENTION

In the following description, the terms "washing solution" and "circulated washing solution" are equivalent and used interchangeably to denote a solution being circulated in petroleum equipment to wash petroleum residue or any other build-ups off the walls of the petroleum equipment.

The present invention has been reached based on the finding that surface-active agents are effective in finely dividing and dispersing the petroleum residue for removal, even in petroleum equipment having no water therein. In other words, washing solutions that contain no water can be used to effectively wash petroleum equipment.

A method of washing petroleum equipment according to an aspect of the present invention is characterized in using a compound of a surface-active agent and petroleum as a washing solution for the petroleum equipment.

A method of washing petroleum equipment according to another aspect of the present invention comprises the steps of:

a) preparing a non-aqueous washing solution consisting of a surface-active agent and petroleum, the petroleum comprising at least one selected from the group consisting of kerosene, light gas oil, vacuum gas oil and light cycle oil fraction;

b) introducing the washing solution inside the petroleum equipment; and c) circulating the washing solution to wash the inside of the petroleum equipment.

Since the washing solution contains no water, there is no need for a rinsing or drying process as required by the conventional arrangement, thus simplifying the whole process and reducing the total downtime of the equipment.

The concentration of the surface-active agent in the washing solution is preferably from about 1 to about 20 volume percentage.

When the concentration of the surface-active agent is less than 1 volume percentage, the washing effect is significantly deteriorated. On the other hand, when the concentration of the surface-active agent exceeds 20 volume percentage, the washing effect increases only slightly, which does not justify the cost of the washing solution.

The temperature of the washing solution during the washing process is less than the boiling point of the solvent of the surface-active agent, which is preferably and normally between the normal temperature and 200° C. The non-aqueous washing solution may preferably be heated while being circulated inside the petroleum equipment thus enhancing washing efficiency.

According to the method of the present invention, at least one property of the washing solution being circulated inside the petroleum equipment may preferably be monitored, and the concentration of the surface-active agent in the non-aqueous washing solution will preferably be adjusted, e.g., increased, when the monitored property or properties do not satisfy a predetermined standard.

The properties may be monitored in any suitable manner, such as visual observation of the washing solution and/or evaluation using a measuring device. The predetermined standard may be set in any manner, considering the type of the petroleum equipment to be washed, acceptable down-times for the petroleum equipment, the properties of the washing solution etc.

The monitored properties of the non-aqueous washing solution preferably include at least one of the hue acid value and the residual carbon content of the circulated washing solution.

According to the method of the present invention, even when the non-aqueous washing solution does not show sufficient performance for washing the petroleum equipment at the initial stage of the washing process, the concentration of the surface-active agent can be adjusted, e.g., increased, during the washing process to attain desired washing efficiency.

In accordance with an embodiment of the present invention, a non-aqueous washing solution having a predetermined concentration, i.e., percentage by volume, of the surface-active agent may be directly introduced into the equipment and circulated therein until the end of the washing process without being changed or adjusted.

However, it is more preferable and flexible if the concentration of the surface-active agent in the non-aqueous washing solution can be adjusted during the washing process. For this purpose, an initial non-aqueous washing solution containing the surface-active agent of a concentration less that the predetermined concentration is first loaded into the equipment to be circulated therein. Thereafter, another, condensed non-aqueous washing solution having the surface-active agent of a concentration greater than the predetermined concentration is introduced in the petroleum equipment. Thus, a resulting washing solution which is a mixture of the initial non-aqueous washing solution and the condensed non-aqueous washing solution is circulated in the petroleum equipment. The resulting washing solution contains the surface-active agent of a concentration higher than the concentration of the initial washing solution but lower than the concentration of the condensed washing solution. Continually introducing the condensed washing solution into the petroleum equipment at, e.g., regular intervals will gradually increasing, or adjusting, the concentration of the surface-active agent in the resulting washing solution being circulated. Simultaneously, one or more properties of the circulated washing solution is/are being monitored for washing efficiency. When a desired washing effect has been reached, the introduction of the condensed washing solution is stopped. The introduction of the condensed washing solution may also be stopped when a maximum desired concentration of the surface-active agent, e.g., 20% by volume, in the circulated washing solution has been reached. The condensed washing solution and the initial washing solution preferably contain the same components, i.e., the same petroleum and surface-active agent, only in different concentrations.

Another embodiment of the present invention can be implemented in substantially the same manner as immediately described above, except that petroleum, instead of the initial washing solution, is introduced into the petroleum equipment. In other words, this embodiment is a particular case of the embodiment immediately described above when the initial washing solution contains no surface-active agent or has a zero concentration of the surface-active agent.

The condensed washing solution may preferably be loaded using injection equipment from a container of the condensed non-aqueous washing solution, with a pump and a pipe. However, when such injection equipment is not available, temporary injection equipment may be provided.

As mentioned above, when the condensed washing solution is used for conditioning/adjusting the concentration of the surface-active agent in the circulated non-aqueous washing solution, handling (such as manufacturing and transferring) of the washing solution can be facilitated, and the concentration of the surface-active agent in the circulated washing solution can be adjusted at an appropriate rate while checking the washing effect.

Especially, when it is necessary to gradually increase the concentration of the surface-active agent in the circulated washing solution, the concentration of the initial washing solution can be initially set low. Then, hue, acid value and residual carbon content of the circulated washing solution may be measured and, if the washing effect is low, the condensed washing solution can be additionally injected, thus easily conditioning the concentration of the circulated washing solution. Accordingly, excessive use of the surface-active agent can be prevented.

In accordance with the present invention, at least one of properties, including constituent thickness and solidness (i.e. consolidation, or hardness) of the petroleum residue inside the petroleum equipment may preferably be measured, and the concentration of surface-active agent in the circulated non-aqueous washing solution may preferably be adjusted in accordance with the measured properties of the petroleum residue.

According to the above arrangement, a non-aqueous washing solution containing a surface-active agent of an appropriate concentration can be introduced at the initial washing stage, thus enhancing washing efficiency.

Furthermore, the properties of petroleum residue and the corresponding concentrations of the surface-active agent in circulated non-aqueous washing solutions, that were sufficient to effectively remove the petroleum residue in previous washing cycles, may preferably be obtained and recorded. Then, in the next washing cycle, properties of the petroleum residue to be removed are measured, and compared with the previously recorded properties. The concentration of the surface-active agent in the circulated non-aqueous washing solution for the next washing cycle may preferably be adjusted to the recorded concentration that has been successfully applied in a previous cycle to remove petroleum residue that has recorded properties most proximate to the measured properties of the petroleum residue to be removed.

Accordingly, the most appropriate non-aqueous washing solution can be loaded in accordance with the results of previously conducted washing processes, thereby further enhancing the washing efficiency.

In addition, the temperature and/or the constituents or components of the circulated non-aqueous washing solution may preferably be adjusted in accordance with the monitored washing effect and properties of the petroleum residue.

The above petroleum equipment includes petroleum facility (heat exchanger, vessel, etc.), reactor filled with catalyst, desalter and tower as well as piping line.

A high boiling-point aromatic compound having a boiling point in the range of 150° C. to 200° C. may preferably be added in the washing solution of the present invention.

The high boiling-point aromatic compound includes single-ring and naphthalene ring compounds having one to three side chains of methyl base, ethyl base, propyl base etc.

The compounding ratio of the high boiling-point compound can be determined at will.

In the washing method of petroleum equipment according to the present invention, the surface-active agent may preferably be one selected from the group consisting of anionic surface-active agent, cationic surface-active agent, amphoteric surface-active agent and nonionic surface-active agent.

The anionic surface-active agent includes carboxylate, sulfonate, sulfate, phosphate etc.

The carboxylate includes ethanolamine soap, N-acyl amino acid, alkyl ether carboxylic acid etc.

The sulfonate includes alkylbenezene sulfonates, alkyl naphthalene sulfonates, melamine sulfonates, dialkyl sulfosuccinic acid, alkyl sulfo-aceitc acid, a-olefin sulfonic acid etc.

The sulfate ester salt includes sulfonated oil, higher alcohol sulfate, alkyl ether sulfuric acid, secondary higher alcohol ethoxy sulfuric acid, polyoxyethylene alkyl phenyl ether sulfuric acid, aliphatic alkylolamide sulfate etc.

The phosphoric ester salt is phosphoric ester such as alkylether phosphate ester, alkyl phosphoric acid ester.

The cationic surface-active agent is, for example, aliphatic amine such as aliphatic quaternary amine.

The amphoteric surface-active agent includes carboxy betaine, sulfo-betaine, amino carboxylate, imidazoline derivative, lecithin etc.

The nonionic surface-active agent includes ether type surface-active agent, ether-ester type surface-active agent, ester type surface surface-active agent, nitrogen-including surface-active agent etc.

The ether type surface-active agent includes polyoxyethylene alkyl ether, polyoxyethylene alcohol ether, polyoxyethylene alkyl phenyl ether etc.

The ether-ester type surface-active agent includes polyoxyethylene sorbitol aliphatic ester etc.

The ester type surface-active agent includes polyethylene glycol aliphatic ester etc.

The nitrogen-including nonionic surface-active agent includes fatty acid alkanolamide, polyoxyethylene fatty acid amide etc.

In the washing method of petroleum equipment according to the present invention, the surface-active agent may preferably be a combination of a nonionic surface-active agent and one selected from the group consisting of an anionic surface-active agent, a cationic surface-active agent and an amphoteric surface-active agent.

The nonionic surface-active agent, anionic surface-active agent, cationic surface-active agent, amphoteric surface-active agent are the same as those described above.

In the washing method of petroleum equipment according to the present invention, the petroleum may preferably be at least one selected from the group consisting of kerosene, light gas oil, vacuum gas oil and light cycle oil obtained from fluid catalystic cracking unit.

The kerosene is a fraction heavier than gasoline and lighter than light gas oil.

The light gas oil is a fraction of middle distillating product of crude distillation unit.

The vacuum gas oil is distillated oil obtained from vacuum distillation unit.

The light cycle oil is a fraction obtained from the fluid catalystic cracking unit.

In the washing method of petroleum equipment according to the present invention, the oil washing solution of the surface-active agent and oil may preferably include at least one of d-limonene and derivative thereof.

The derivative of d-limonene includes citral etc.

The compounding ratio of d-limonene may be determined at will.

By adding d-limonene into the washing solution, the solubility of the petroleum residue in the washing solution can be enhanced.

In the washing method of petroleum equipment according to the present invention, warm water may be used for further washing the equipment after washing using the non-aqueous washing solution.

The temperature of the warm water is preferably from about 30° C. to about 90° C.

After the washing process using a mixture of petroleum and a surface-active agent as the washing solution, the mixture is discharged.

The warm water washing may preferably be done after the washing process using the washing solution.

After the water washing process using warm water, the petroleum equipment may preferably be rinsed using a non-aqueous rinsing solution including or consisting of petroleum. Accordingly, undesirable influence caused by water can be prevented.

In the above water washing process, the warm water may preferably include a water-soluble surface-active agent.

An example of the water-soluble surface-active agent is alkylolamide sulfate, alkyl phosphoric acid ester etc. The surface-active agent may be a single compound or a combination of multiple compounds.

The concentration of the water-soluble surface-active agent in the non-aqueous rinsing solution may preferably be in the range from about 0.1 to about 5% by volume. When the concentration is less than 0.1% by volume, the washing effect is significantly deteriorated, and when the concentration exceeds 5% by volume, the cost for the surface-active agent unacceptably increases as compared to a slight increase in the washing efficiency.

The concentration of the water-soluble surface-active agent can be adjusted in the same manner as the surface-active agent used during the washing process.

DETAILED DESCRIPTION OF PREFERRED EMBODIMENT(S)

First Experiment

Figure 1:
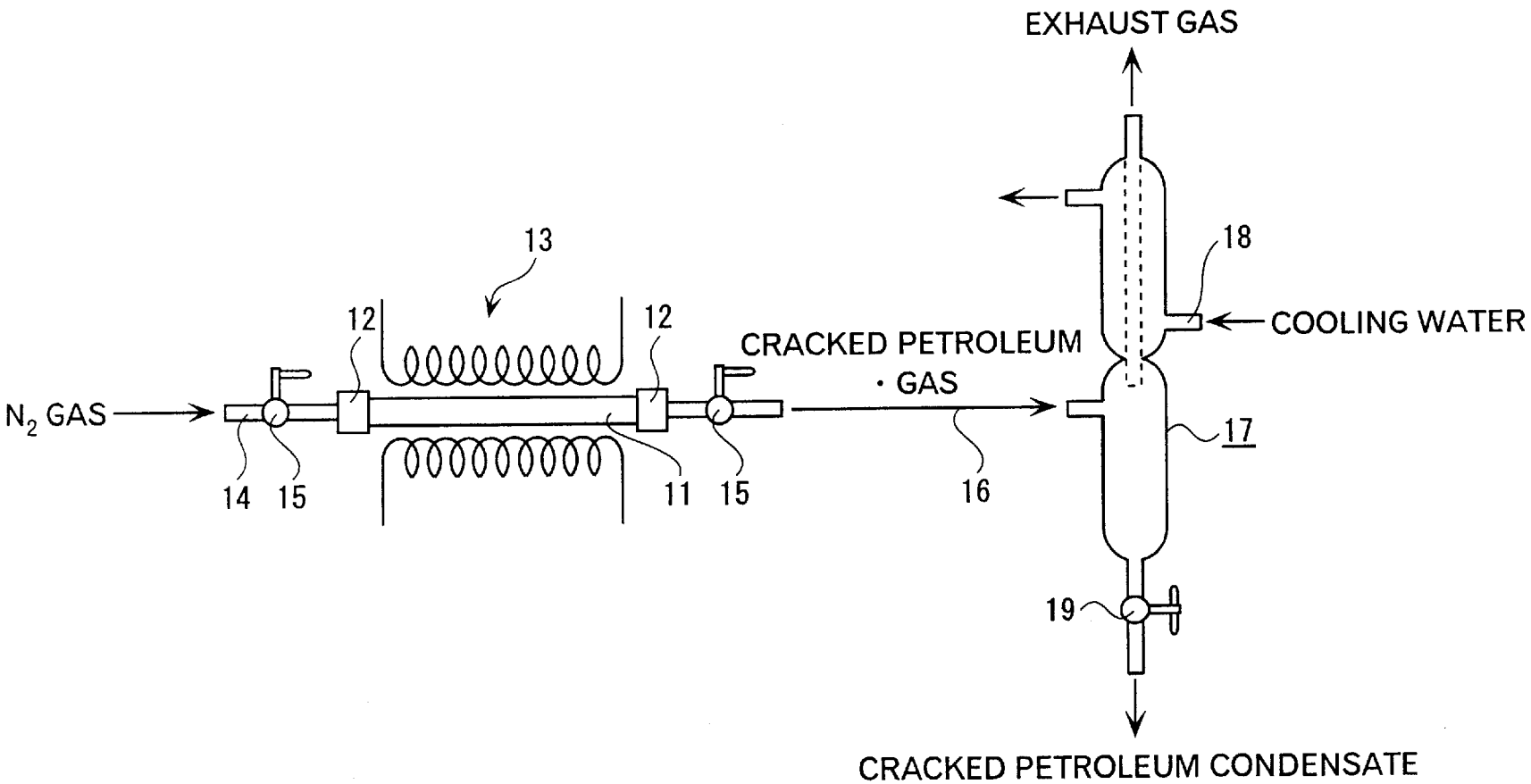
FIG. 1 is a schematic illustration of an apparatus used for producing petroleum crack residue in second experiment.

Five steel test panels for salt-spray test (according to JIS K 2246. Size: 1.2 * 60 * 80 mm) are used as test pieces (A to E). After the test pieces are washed by xylene, straight-run asphalt (penetration number: 76, softening point: 48.5° C.) heated and melted at 150° C. is coated on a central portion of a one-side of the test piece by a brush as even as possible. Peripheral portion remains uncoated for holding the test pieces. Incidentally, heated and polymerized asphalt (asphaltene) resembles petroleum residue actually heated and polymerized in the petroleum refining equipment.

Subsequently, test pieces are cooled by normal cooling, and the coated asphalt is weighed respectively.

Thereafter, the test pieces are heated by a desktop electric heater with coated surface upside while grasping an end of the test piece with a pair of pliers. During heating process, the test pieces are moved toward and away from the electric heater so that excessive cracked petroleum soot does not generate, and inclination of the test pieces are adjusted so that molten asphalt does not overflow. The heating process is suspended when only a little soot is generated in bringing the test pieces close to the electric heater to heat considerably strongly (after thirty to forty minutes from initiating the heating process).

The test pieces are immediately put into constant temperature (250° C.) thermoregulator (natural convection type: maximum temperature 300° C.). The thermoregulator is ventilated (opening a sliding door and rapidly introducing fresh air by a paper fan) every thirty minutes in the initial five hours and every an hour in the subsequent eight hours for preventing the soot. The heating process at the constant temperature continues until termination after total of eighty-five hours and the test pieces are left to be cooled to room temperature.

The test pieces are weighed and residual asphalt amount is measured.

A: 1.7 g, B: 1.8 g, C: 1.0 g, D: 0.9 g, E: 2.3 g

When crack rate (including evaporation) is defined as: crack rate (%)=(Wi−Wt)/Wt*100 (Wi: asphalt weight before heating, Wt: asphalt weight after heating), the crack rate of respective test pieces A to E is as follows:

A: 73%, B: 65%, C: 82%, D: 81%, E: 69%

Five fluorine-resin (PFA) jars with lid (Internal diameter: 80 mm, height: 72 mm, volume: 400 ml) are prepared and washing solution is put thereinto to examine removal rate of residual asphalt on the test pieces A to E.

The washing solution of respective example is composed of compound of surface-active agent (1–20 volume %) and oil.

The surface-active agent is selected from anionic surface-active agent, cationic surface-active agent, nonionic surface-active agent and amphoteric surface-active agent.

The oil is selected from kerosene, light gas oil, vacuum gas oil and light cycle oil obtained by fluid catalystic cracking unit.

EXAMPLE 1

The test piece A was put into the jar and 300 ml of washing solution having compound of 95 volume percent of kerosene and 5 volume percent of alkylether phosphate monoester was therein.

When the jar was left in a constant temperature (80° C.) container, the washing solution gradually got blackened.

The test piece A was taken out from the jar after two hours, soaked in hexane filled in a relatively large beaker, washed by softly shaking, lifted the test pieces from the hexane after ten seconds and naturally dried thereafter.

It was observed by visual check that the test piece A had no lump of asphalt and the asphalt had almost entirely removed.

Weighed residual asphalt amount was less than 0.1 g.

The removal rate of the asphalt was calculated in the same manner as the aforesaid crack rate, which was 94%.

According to the present example, even when there is no water, the asphalt on the test piece could be removed at high efficiency using the washing solution composed of surface-active agent and kerosene. Accordingly, it was found that the washing solution of the present example could achieve washing effect similar to washing with water even in washing petroleum equipment having no water therein.

EXAMPLE 2

The test piece B was put into the jar and 300 ml of washing solution having compound of 85 volume percent of light gas oil, 10 volume percent of d-limonene and 5 volume percent of polyoxyethylene secondary higher alcohol ether was poured therein.

When the jar was set in a constant temperature (80° C.) container, the test piece B was taken out from the jar after two hours and washing and drying steps were conducted in the same manner as Example 1.

Weighed residual asphalt amount was less than 0.1 g.

The calculated removal rate of the asphalt was 94%.

The washing solution of the present example contained surface-active agent and light gas oil, and further contained d-limonene, the asphalt on the test piece could be removed at a high rate.

EXAMPLE 3

The test piece E was put into the jar and 300 ml of washing solution containing 80 volume percent of vacuum gas oil, 10 volume percent of high boiling-point aromatic hydrocarbon (kerosene including more than 40% of benzene-ring compound having substituent of methyl base and ethyl base), 5 volume percent of n-alkylbenzene sulfonates and 5 volume percent of polyoxyethylene fatty acid was poured therein.

After leaving the jar in a constant temperature container of 80° C. for an hour, the test piece E was taken out from the jar. The washing solution was slightly whitened.

Subsequently, the test piece E was soaked in 90 to 95° C. of hot water for an hour just before being boiled, the test piece was washed and dried in the same manner as Example 1.

Weighed residual asphalt amount was less than 0.1 g.

The calculated removal rate of the asphalt was 96%.

Since the washing solution of the present example contained surface-active agent and vacuum gas oil, and further, contained high boiling-point aromatic compound hydrocarbon, the asphalt on the test piece could be removed at further higher rate.

Additionally, it was found that washing effect could be further improved by washing with warm water after circulation washing in the oil washing solution. This is because a part of the surface-active agent permeates into the asphalt, which enhanced emulsification of the asphalt in contact with the warm water.

Comparison 1

The test piece C was used instead of the test piece A and only light gas oil was used as the washing solution for conducting the same process as the example 1.

It was observed through visual check that there were some lumps of asphalt left on the test piece C.

Weighed residual asphalt amount was 0.3 g.

Calculated removal rate of the asphalt in the same manner as the aforesaid crack rate was 70%.

According to the present comparison, since the washing solution was only light gas oil, the removal rate of the asphalt on the test piece was low.

Comparison 2

The test piece D was used instead of test piece A and washing solution of 50 volume percent of light gas oil and 50% volume percent of d-limonene was used for the same process as the example 1.

It was observed through visual check that no lump of asphalt was seen on the test piece and most of the asphalt had removed.

Weighed residual asphalt amount was 0.1 g.

The removal rate calculated in the same manner as the aforesaid crack rate was 88%.

According to the present comparison, since d-limonene was added in the light gas oil, removal rate of the asphalt was improved as compared to the comparison 1. However, since no surface-active agent was contained, the removal rate is not so high as the above-described examples.

Second Experiment

Figure 2:
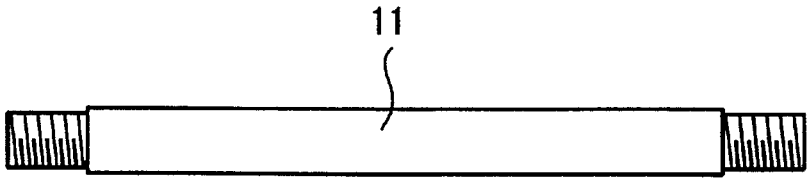
FIG. 2 shows a pipe used in the second experiment.

Initially, generating method of cracked petroleum residue will be described below with reference to FIGS. 1 and 2.

A steel pipe 11 (outer diameter: 2.54 cm, length: 300 mm, screw length: 30 mm) is prepared and 200 g asphalt molten at 120 to 130° C. is filled into the steel pipe 11 from an end thereof with the other end being closed by a screw cap 12. Subsequently, after the screw cap 12 is attached to the open end of the pipe 11, the pipe 11 is rotated in up, down, right and left direction for ten minutes, so that the asphalt adheres on the inside of the pipe 11 as uniform as possible.

Subsequently, the screw cap 12 is opened to discharge the asphalt not adhered in the pipe 11. The asphalt is preferably adhered in the pipe 11 at a thickness of 3 to 5 mm after the pipe 11 is cooled, and when the thickness is more than 5 mm, the rotation work of ten minutes is shortened to adjust thickness.

After the pipe 11 is naturally cooled for an hour, the screw cap 12 is detached to weigh the asphalt adhered in the pipe 11. The pipe 11 is set in an openable high-temperature electric tube furnace 13 (temperature range: normal temperature to 1400° C., furnace inner dimension: 30*300 mm). One end of the pipe 11 is connected to a copper thin tube 16 having a valve 15 through the screw cap 12 and the other end thereof is connected to another copper thin tube 16 having a valve 15 and oil/gas separating tube 17. The oil/gas separating tube 17 is provided with a cooling pipe 18 and an extraction valve 19.

With the right and left valves 15 being open, the tube furnace 13 is gradually heated while gradually flowing nitrogen gas from the right (in the figure) thin tube 14 to the pipe 11. The temperature of the furnace is naturally raised up to 100° C., and the temperature is raised at a rate of 20° C. per an hour from 100 to 200° C. In the range from 100 to 200° C., the pipe 11 is slowly rotated (alternate rotation) every one hour by a pipe wrench, so that uniform layer of asphalt and cracked heavy oil is formed on the inner wall of the pipe 11.

In the range from 200 to 300° C., the same step is repeated while raising the temperature at a rate of 15° C. per an hour. After the amount of the cracked petroleum condensate reaches half of the initial asphalt (70 ml in 5 mm layer), the temperature is quickly raised up to 350° C. without rotating the pipe 11 and the temperature is maintained for five hours.

After natural cooling, solidified asphalt is weighed.

Five pipes (F to J) 11 produced by the above process are prepared.

Figure 3:
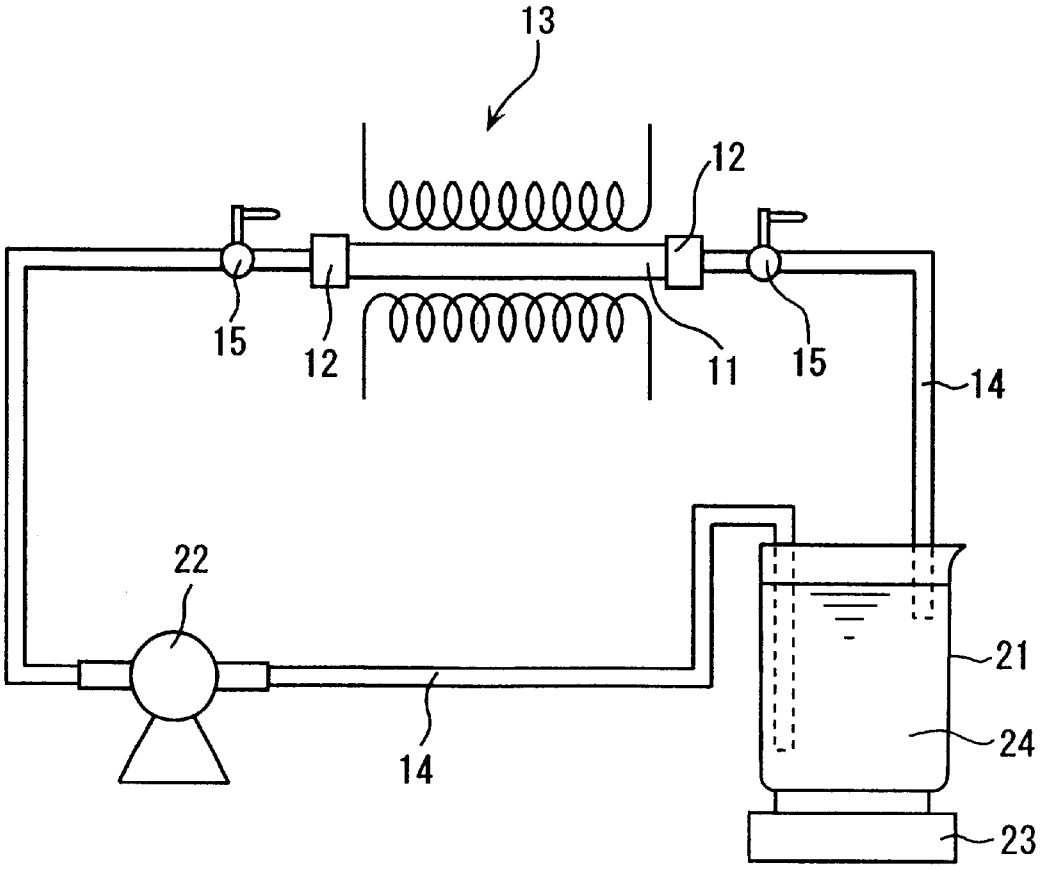
FIG. 3 is a schematic illustration showing an apparatus used in the second experiment.

Next, washing method will be described below with reference to FIG. 3. The equipment used in the method includes the openable high-temperature electric tube furnace 13, a vessel 21 connected to the tube furnace 13 by the copper thin tube 14, and a pump 22 provided between the thin tube 14 and the vessel 21. Cloth (not shown) is repeatedly superposed around the thin tube 14 and the vessel 21 for avoiding lowering of fluid temperature. The vessel 21 is located on the electric heater 23.

Washing solution 24 is poured into the vessel 21 and the washing solution 24 is circulated by the pump 22 at 150 ml/15 min through the pump. The washing solution 24 of the present example is composed of a compound of the surface-active agent and oil as in the first experiment, which includes 1 to 20 volume percent of surface-active agent.

EXAMPLE 4

In the second experiment, 450 ml of washing solution having 70 volume percent of light gas oil, 20 volume percent of high boiling-point aromatic solvent, and 10 volume percent of polyoxyethylene alkylether (ethyleneoxide 5–9 mol adduct) was poured into the vessel and the asphalt adhered in the pipe F is washed by circulating the washing solution for six hours while keeping the temperature of the washing solution at 150° C±10° C. The definition of the high boiling-point aromatic solvent is a solvent including more than 35% of 2-ethyl (or 3-ethyl, 4-ethyl) toluene and more than 50% of trimethylbenzene.

Subsequently, after completion of the circulating with washing solution and natural cooling process, the pipe F was further washed by changing the solution in the vessel to hexane. Circulation amount of the hexane was 450 ml (about 3 times as large as the pipe volume), the temperature was room temperature, and circulation time was 10 minutes.

Adhered asphalt amount in the pipe F, amount of the cracked residue, crack rate (wt %), residual amount after washing by the washing solution, dissolution removal rate of the asphalt and final dissolution removal rate of the asphalt were measured. The results are shown in Table 1.

EXAMPLE 5

As a washing solution poured into the vessel, a compound of 70 volume percent of light gas oil, 10 volume percent of d-limonene, 10 volume percent of polyoxyethylene sorbitol aliphatic ester, and 10 volume percent of alkyl phosphoric acid ester was prepared.

In the same manner as the example 4, the washing solution was used to wash the asphalt adhered in the pipe G.

And final asphalt dissolution removal rate etc. was measured in the same manner as the example 4.

EXAMPLE 6

In the present example, the same washing solution as the example 4 (70 volume percent of light gas oil, 20 volume percent of high boiling-point aromatic solvent, 10 volume percent of polyoxyethylene alkylether) at 150° C. was used to wash the asphalt adhered in the pipe H.

Further, the washing solution (95 volume percent of water and aliphatic alkylolamide sulfate salt) at 80° C. was used to wash the asphalt adhered in the pipe H.

And the final dissolution removal rate of asphalt etc. was measured in the same manner as the example 4. In the present example, residual amount after second washing process was also measured.

EXAMPLE 7

In the present example, the same oil washing solution as the example 5 (70 volume percent of light gas oil, 10 volume percent of d-limonene, 10 volume percent of polyoxyethylene sorbitol aliphatic ester, and 10 volume percent of alkyl phosphoric acid ester) at 150° C. was used to wash the asphalt adhered in the pipe I.

Subsequently, another washing solution (95 volume percent of water and 5 volume percent of aliphatic alkyl phosphorate) at 80° C. was used to wash the remained asphalt adhered in the pipe I.

Final dissolution removal rate of asphalt etc. was measured in the same manner as the example 6.

Comparison 3

100 volume percent of light gas oil was prepared as washing solution to be poured into the vessel.

The asphalt adhered in the pipe J was washed by the washing solution in the same manner as example 4.

Further, in the same manner as example 4, final dissolution removal rate of the asphalt etc. were measured.

TABLE 1

| | Example 4 | Example 5 | Example 6 | Example 7 | Comparison 3 |
|---|---|---|---|---|---|
| Adhered asphalt amount | 106 | 130 | 113 | 125 | 141 |
| Cracked residue | 33 | 36 | 26 | 34 | 35 |
| Crack rate (wt %) | 69 | 72 | 77 | 73 | 75 |

TABLE 1-continued

| | Example 4 | Example 5 | Example 6 | Example 7 | Comparison 3 |
|---|---|---|---|---|---|
| Residual amount after being washed by washing solution | 5 | 7.6 | 3.6 | 8.5 | 12 |
| Dissolution removal rate | 85 | 79 | 81 | 75 | 66 |
| Residual amount after being washed by warm water | — | — | 1.3 | 3.7 | — |
| Final dissolution removal rate | 85 | 79 | 94 | 89 | 66 |

According to Table 1, it can be observed that the asphalt could be highly efficiently removed using washing solution composed of compound of surface-active agent and light gas oil in a waterless environment in the examples 4 to 7.

Further, good washing effect could be obtained by adding d-limonene and high boiling-point aromatic compound into light gas oil.

According to examples 6 and 7, since washing process by warm water adding the surface-active agent, washing effect can be further enhanced.

Accordingly, by the washing solution of examples 4 to 7, the same washing effect as in an environment having water can be obtained even in washing the petroleum equipment having no water therein.

On the other hand, in the comparison 3, since the washing solution is composed only of light gas oil, the washing rate is relatively low.

According to the washing method of petroleum equipments of the present invention, since the washing solution including surface-active agent and kerosene etc. is used to wash, good washing effect can be obtained even without water.

What is claimed is:

1. A method of washing an interior of petroleum equipment, said method comprising the steps of:

a) preparing a non-aqueous washing solution comprising a surface-active agent and petroleum, wherein the petroleum comprises at least one selected from the group consisting of kerosene, light gas oil, vacuum gas oil and light cycle oil fraction;

b) introducing the non-aqueous washing solution into the interior of the petroleum equipment;

c) circulating the non-aqueous washing solution to wash the interior of the petroleum equipment;

d) monitoring at least one property of the non-aqueous washing solution circulated within the interior of the petroleum equipment and when the monitored property does not satisfy a predetermined standard, adjusting the concentration of the surface-active agent in the non-aqueous washing solution, wherein the monitored property of the non-aqueous washing solution includes at least one of hue, acid value and residual carbon content.

2. The washing method according to claim 1, wherein said non-aqueous washing solution containing the surface-active agent at a concentration less than a predetermined surface-active agent concentration is introduced into the interior of the petroleum equipment to be circulated therein, and the concentration of the surface-active agent is adjusted by adding another non-aqueous washing solution containing the surface-active agent at a concentration higher than the predetermined surface-active agent concentration to the non-aqueous washing solution being circulated within said petroleum equipment.

3. The washing method according to claim 1, further comprising adjusting a temperature and/or a constituent of the non-aqueous washing solution in accordance with at least one of the properties of the non-aqueous washing solution.

4. The washing method according to claim 1, wherein the surface-active agent is selected from the group consisting of anionic surface-active agents, cationic surface-active agents, nonionic surface-active agents and amphoteric surface-active agents.

5. The washing method according to claim 1, wherein the surface-active agent is a combination of a nonionic surface-active agent and one selected from the group consisting of an anionic surface-active agent, a cationic surface-active agent and an amphoteric surface-active agent.

6. The washing method according to claim 1, wherein the non-aqueous washing solution further includes at least one of d-limonene and citral.

7. The washing method according to claim 1, wherein the concentration of the surface-active agent in the non-aqueous washing solution circulated in the interior of the petroleum equipment is from about 1% to about 20% by volume.

8. The washing method according to claim 1, wherein the non-aqueous washing solution further contains a high boiling-point aromatic compound having a boiling point in the range of from about 150° C. to about 200° C., the high boiling-point aromatic compound including single-ring compounds and naphthalene-ring compounds each having one to three side chains of methyl base, ethyl base, and propyl base.

9. The washing method according to claim 1, wherein the petroleum equipment is rinsed by warm water at a temperature of from 30° C. to 90° C. after being washed by the non-aqueous washing solution.

10. The washing method according to claim 9, wherein the warm water contains a water-soluble surface-active agent.

11. The washing method according to claim 10, wherein the concentration of the water-soluble surface-active agent in the warm water is from about 0.1 to about 5% by volume.

12. A method of washing petroleum equipment, comprising the steps of:

a) preparing a non-aqueous washing solution comprising a surface-active agent and petroleum, wherein the petroleum comprises at least one selected from the group consisting of kerosene, light gas oil, vacuum gas oil and light cycle oil fraction;

b) introducing the non-aqueous washing solution into an interior of the petroleum equipment;

c) circulating the non-aqueous washing solution to wash the interior of the petroleum equipment; and d) measuring at least one property including thickness, hardness, and a constituent of petroleum residue to he removed from the interior of the petroleum equipment, and adjusting the concentration of the surface-active agent in the washing solution in accordance with a measured value of said property of the petroleum residue.

13. The washing method according to claim 12, wherein the concentration of the surface-active agent in the non-aqueous washing solution is adjusted by obtaining records of previously measured values of said property of the petroleum residue and corresponding previously used concentrations of the surface-active agent that were successfully used in previous washing cycles to remove petroleum residue that exhibited said previously measured values for said property of the petroleum residue;

comparing the measured value of said property of the petroleum residue to the previously measured values of said property of the petroleum residue to determine a closest previously measured value of said property of the petroleum residue that is most proximate to the measured value of said property of the petroleum residue; and adjusting the concentration of the surface-active agent in the non-aqueous washing solution to the previously used concentration corresponding to the closest previously measured value of said property of the petroleum residue.

14. The washing method according to claim 12, further comprising adjusting a temperature and/or a constituent of the non-aqueous washing solution in accordance with the measured property of the petroleum residue.

15. A method of washing petroleum equipment, comprising the steps of:

a) preparing non-aqueous washing solution comprising a surface-active agent and petroleum, wherein the petroleum comprises at least one selected from the group consisting of kerosene, light gas oil, vacuum gas oil and light cycle oil fraction;

b) introducing the non-aqueous washing solution into an interior of the petroleum equipment;

c) circulating the non-aqueous washing solution to wash the interior of the petroleum equipment; and d) rinsing the interior of the petroleum equipment with warm water at a temperature of from 30° C. to 90° C. after being washed by the non-aqueous washing solution, wherein the warm water contains a water-soluble surface-active agent including at least one of alkylolamide sulfate or alkyl phosphoric acid ester.

16. A method of washing an interior of petroleum equipment, comprising the steps of:

a) introducing a first washing solution consisting of petroleum into the interior of the petroleum equipment, wherein the petroleum comprises at least one selected from the group consisting of kerosene, light gas oil, vacuum gas oil, and light cycle oil fraction;

b) circulating the first washing solution into the interior of the petroleum equipment;

c) additionally introducing a second, non-aqueous, condensed washing solution consisting of said petroleum and a surface-active agent into the interior of the petroleum equipment; and d) washing the interior of the petroleum equipment by circulating therein a resulting washing solution including the first and second washing solutions.

* * * * *